US007802530B2

(12) United States Patent
Nanami

(10) Patent No.: US 7,802,530 B2
(45) Date of Patent: Sep. 28, 2010

(54) PERSONAL WATERCRAFT

(75) Inventor: Masayoshi Nanami, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 225 days.

(21) Appl. No.: 11/871,478

(22) Filed: Oct. 12, 2007

(65) Prior Publication Data

US 2008/0096445 A1 Apr. 24, 2008

(30) Foreign Application Priority Data

Oct. 12, 2006 (JP) ..... 2006-278440

(51) Int. Cl.

| | |
|---|---|
| ***B63B 35/73*** | (2006.01) |
| ***B63H 11/10*** | (2006.01) |
| ***B63H 25/00*** | (2006.01) |
| ***B63H 25/14*** | (2006.01) |
| ***B63H 25/24*** | (2006.01) |

(52) U.S. Cl. ..... 114/144 R; 114/144 RE; 440/1

(58) Field of Classification Search ..... 114/144 R, 114/150, 144 RE, 144 E; 440/40–43, 1; 701/21, 701/41, 42

See application file for complete search history.

(56) References Cited

U.S. PATENT DOCUMENTS

| | | | | |
|---|---|---|---|---|
| 7,270,068 | B2 * | 9/2007 | Mizutani | 114/144 RE |
| 2005/0199169 | A1 * | 9/2005 | Mizutani | 114/144 RE |

FOREIGN PATENT DOCUMENTS

| | | | |
|---|---|---|---|
| JP | 2001-329881 | A | 11/2001 |
| JP | 2003002290 | A * | 1/2003 |
| JP | 2006224695 | A * | 8/2006 |

* cited by examiner

*Primary Examiner*—Ajay Vasudeva
(74) *Attorney, Agent, or Firm*—Keating & Bennett, LLP

(57) ABSTRACT

A personal watercraft can have a steering nozzle pivoting in accordance with the operation of a steering handle unit to change the traveling direction of a vehicle body. A steering position sensor can be configured to detect the steering angle of the steering handle unit. An actuator can be arranged to pivot the steering nozzle to change the steered angle thereof. A running speed sensor can be configured to detect the running speed of the vehicle body, and a control device. The control device can determine an operational amount of the actuator and control the actuator based upon the detection amount of the steering position sensor, the running speed sensor, and a steering ratio preset with reference to the steering angle and the running speed. The steering ratio is set to be smaller as the running speed becomes larger.

8 Claims, 8 Drawing Sheets

PERSONAL WATERCRAFT

CROSS-REFERENCE TO RELATED APPLICATIONS

The present application is based on and claims priority under 35 U.S.C. §119(a-d) to Japanese Patent Application No. 2006-278440, filed on Oct. 12, 2006, the entire contents of which is expressly incorporated by reference herein.

BACKGROUND OF THE INVENTION

1. Field of the Inventions

The present inventions relate to boats that can be steered by pivoting a steering nozzle in accordance with an operation of a steering handle unit.

2. Description of the Related Art

The heading of boats, such as jet-powered type boats, can be changed at the desire of the operator by the movement of a steering handle unit on the watercraft. For example, a personal watercraft is one of these types of boat. Personal watercraft typically also have a throttle lever adjacent to a grip of the steering handle unit. The throttle lever is used to control the power output of the engine.

The engine of a jet type boat drives a jet pump which draws water in and discharges the water rearwardly to generate a propulsion force. A steering nozzle is disposed at a rear end of the jet pump. In accordance with the operation of the steering handle unit, the steering nozzle pivots to change a direction of the water discharged from the jet pump. The traveling direction of the vehicle body thus can be changed.

A conventional steering pump for a personal watercraft such as that described above, has a push-pull cable connecting the steering handle unit with the steering nozzle. More particularly, the steering nozzle is disposed at the nozzle opening of the jet pump and is mounted for pivotal movement about a vertical axis. When the push-pull cable is pushed or pulled in accordance with the operation of the steering handle unit, the steering nozzle is directed rightward or leftward in a generally horizontal plane. Because the steering handle unit and the steering nozzle are directly connected to each other through the push-pull cable, in the conventional personal watercraft, the steering ratio (which is a ratio of a steered angle of the steering nozzle relative to a steering angle of the steering angle) is constant over the entire range of movement, regardless of the speed of the personal watercraft.

The water jet passing through the steering nozzle in an upper speed range of operation can be more powerful than under other conditions. Because of the difference in the force resulting from a higher speed water jet in contrast to a lower speed water jet, and because of the direct connection through the push-pull cable, the steering loads during operation at higher speeds and lower speeds are inevitably different from each other.

In addition, the push-pull cable systems extending between the steering handle unit and the steering nozzle cannot be bent around sharp corners, which thus requires special routing and the allocation of more space for routing of these cable or cables. In other words, the push-pull cable needs to be laid as straightly as possible. If the push-pull cable is laid under a preferable, non-bent condition, the space available for positioning other devices or components becomes limited. Thus, the use of push-pull cables makes it more difficult to effectively use the space inside of an engine room of a boat.

SUMMARY OF THE INVENTION

An aspect of at least one of the embodiments disclosed herein includes the realization that, for personal watercraft utilizing the push-pull cable system to control the steering nozzle, the steering ratio, i.e., the angle of the steering handle unit relative to the steering nozzle, cannot be adjusted during the operation of the personal watercraft for varying speeds of the personal watercraft. One way to control the steering ratio of the personal watercraft relative to the speed of the watercraft is to use control device and an actuator in communication with a steering handle unit and a speed sensor unit to control the steering nozzle of the personal watercraft.

Thus, in accordance with an embodiment, a personal watercraft can have a steering handle unit and a steering nozzle configured to pivot in accordance with an operation of the steering handle unit to change a traveling direction of a body of the personal watercraft. The personal watercraft can comprise a steering position sensor configured to detect a steering angle of the steering handle unit, an actuator configured to pivot the steering nozzle to change a steered angle thereof, a running speed sensor configured to detect a running speed of the vehicle body. A control device can be configured to determine an operational amount of the actuator based upon a detection amount of the steering position sensor, a detection amount of the running speed sensor, and a preset steering ratio that is dependant on the steering angle of the steering handle unit and the running speed of the vehicle body, and to control an operation of the actuator in response to the operational amount so as to pivot the steering nozzle.

In accordance with another embodiment, a personal watercraft can have a steering handle unit and a steering nozzle pivoting in accordance with an operation of the steering handle unit to change a traveling direction of a body of the personal watercraft. The watercraft can comprise a steering position sensor configured to detect a steering angle of the steering handle unit. An actuator can be arranged to pivot the steering nozzle to change a steered angle thereof. A running speed sensor configured to detect a running speed of the vehicle body. Additionally, a control device configured to control the actuator based upon a detection amount of the steering position sensor and a detection amount of the running speed sensor so as to pivot the steering nozzle to a steered angle, the control device being configured to control the actuator so as to limit the steered angle of the steering nozzle to a maximum amount that changes based on the running speed of the body when the steering handle unit is turned all the way to the left or all the way to the right.

In accordance with yet another embodiment, a method can be provided for controlling a traveling direction of a body of a personal watercraft relative to a running speed of the body of the personal watercraft. The method can comprise detecting a steering angle of a steering handle unit of the personal watercraft with a steering position sensor. The method can also include detecting a running speed of the vehicle body with a running speed sensor and pivoting a steering nozzle with an actuator that is controlled by a control device configured to determine an operational amount of the actuator based upon a detection amount of the steering position sensor, a detection amount of the running speed sensor, and a steering ratio preset with reference to the steering angle of the steering handle unit and the running speed of the vehicle body, and to control an operation of the actuator based on the operational amount so as to pivot the steering nozzle.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the 10 Figures.

DETAILED DESCRIPTION OF THE PREFERRED EMBODIMENT

FIGS. 1-10 illustrate embodiments of the present steering systems. These embodiments are disclosed in the context of a personal watercraft because they have particular utility in this context. However, these steering systems can be used in other contexts, such as, for example, but without limitation, other types of boats, and other vehicles including land vehicles.

Figure 1:
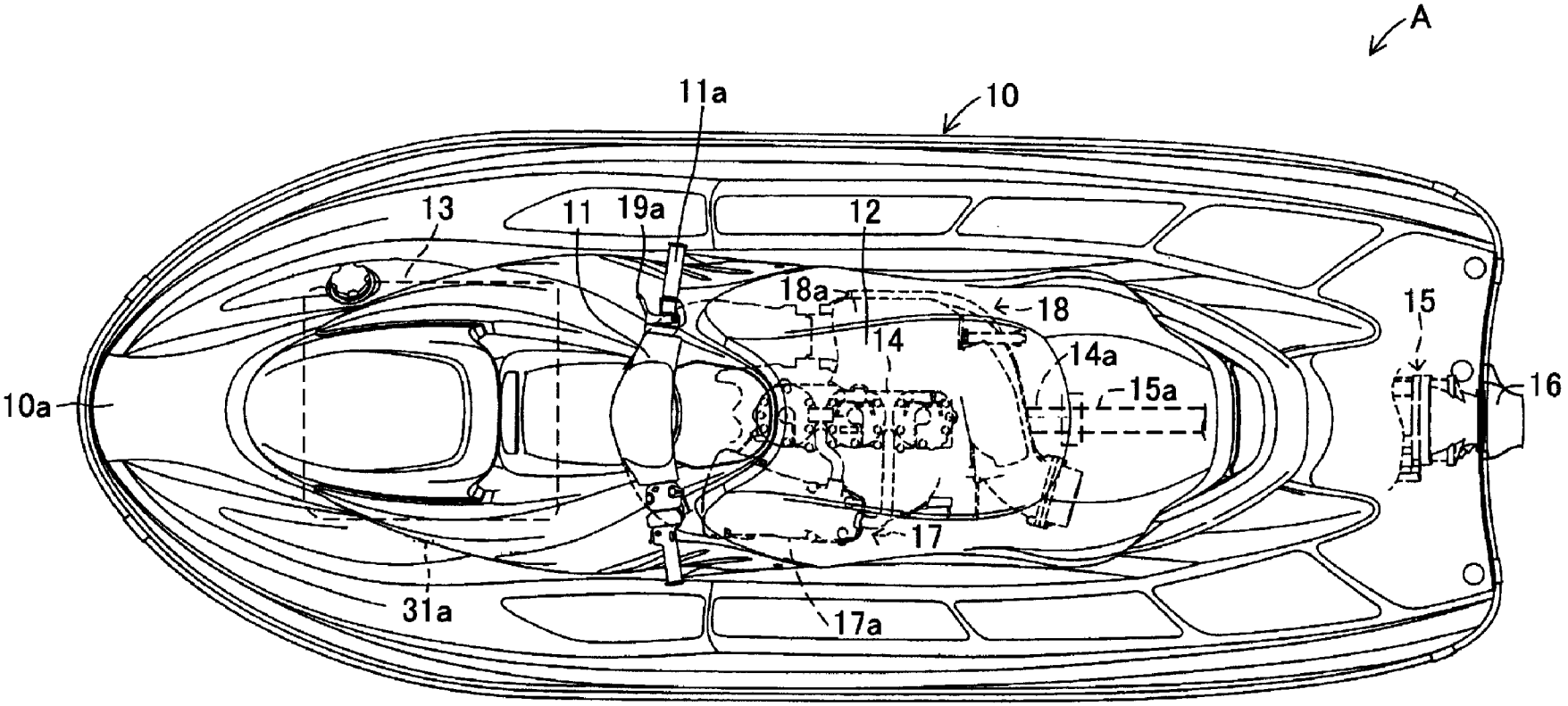
FIG. 1 a top plan view of a personal watercraft configured in accordance with an embodiment.
Figure 2:
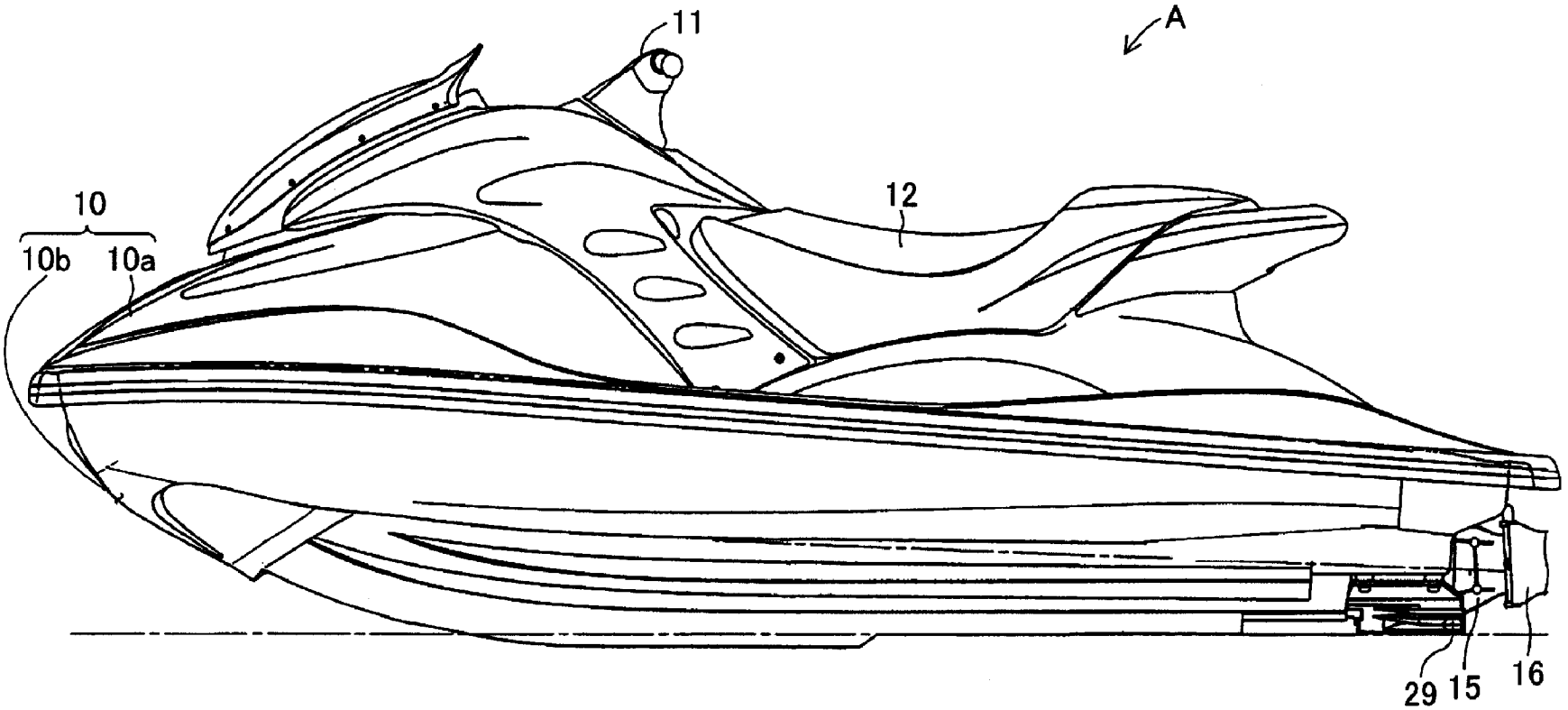
FIG. 2 is a side view of the personal watercraft of FIG. 1.

FIGS. 1 and 2 show a personal watercraft A which can include a vehicle body 10 formed with a deck 10*a* and a hull 10*b*. A steering handle unit 11 can be disposed in the upper section of the vehicle body 10 at a position in the vehicle body 10 that is slightly forward of the center point of vehicle A. A seat 12 can be disposed at the center portion in the upper section of the vehicle body 10 so that the rider can be seated on the personal watercraft A.

A fuel tank 13 can be disposed inside the bottom section of the vehicle body 10 at the front portion of the vehicle body 10 to contain fuel. An engine 14 can be disposed inside of the bottom section of the vehicle body 10 at a center portion of the vehicle body 10.

A propulsion unit 15 can be disposed at the lateral center of the rear end section of the vehicle body 10. The propulsion unit 15 can be coupled with the engine 14 through an impeller shaft 15*a*. The impeller shaft 15*a* can be formed of a single shaft or a plurality of shafts connected together with splined connectors, for example.

A steering nozzle 16 can be mounted to the rear end portion of the propulsion unit 15. The steering nozzle 16 can be electrically connected to the steering handle unit 11. The steering nozzle 16 can be configured to pivot selectively rightward and leftward in accordance with the operation of the steering handle unit 11 to change the traveling direction of the personal watercraft A rightward or leftward. The control of the steering nozzle 16 is described in further detail below.

An intake device 17 and an exhaust device 18 can be connected to the engine 14. The intake device 17 can be configured to deliver an air/fuel mixture to the engine 14 of air and the fuel supplied from the fuel tank 13. The exhaust device 18 can be configured to guide exhaust gases coming from the engine 14 to an external location at the rear end section of the vehicle body 10.

The air/fuel mixture can be introduced into the engine 14 through an intake opening (not shown) communicating with the intake device 17. The intake device 17 can include an intake conduit 17*a* connected to the engine 14, a throttle body 17*a* connected to an upstream end of the intake conduit 17*a* and so forth. However, other configurations can also be used.

The exhaust gases can be discharged from the engine 14 through an exhaust opening (not shown) communicating with the exhaust device 18. The exhaust device 18 can include an exhaust conduit 18*a* connected to the engine 14, a water-lock connected to a rear portion of the water-lock and an exhaust pipe.

During operation, the air/fuel mixture supplied to the engine 14 through the intake opening is ignited by an ignition device of the engine 14 to burn. With the air/fuel mixture being burned, pistons (not shown) reciprocally move within the engine 14. The reciprocal movement of the pistons rotates a crankshaft 14*a*. The crankshaft 14*a* is coupled with the impeller shaft 15*a*. Thus, the power of the engine 14 is transmitted to the impeller shaft 15*a*, i.e., the power of the engine 14 rotates the impeller shaft 15*a*.

A rear end portion of the impeller shaft 15*a* can be coupled with an impeller (not shown) disposed inside of the propulsion unit 15. The impeller rotates to generate thrust for moving the personal watercraft A. For example, the propulsion unit 15 can have a water intake opening at the bottom of the vehicle body 10 and a discharge nozzle that opens at the stern thereof. The rotation of the impeller spouts out or "jets" the seawater out through the discharge nozzle to generate thrust.

Figure 6:
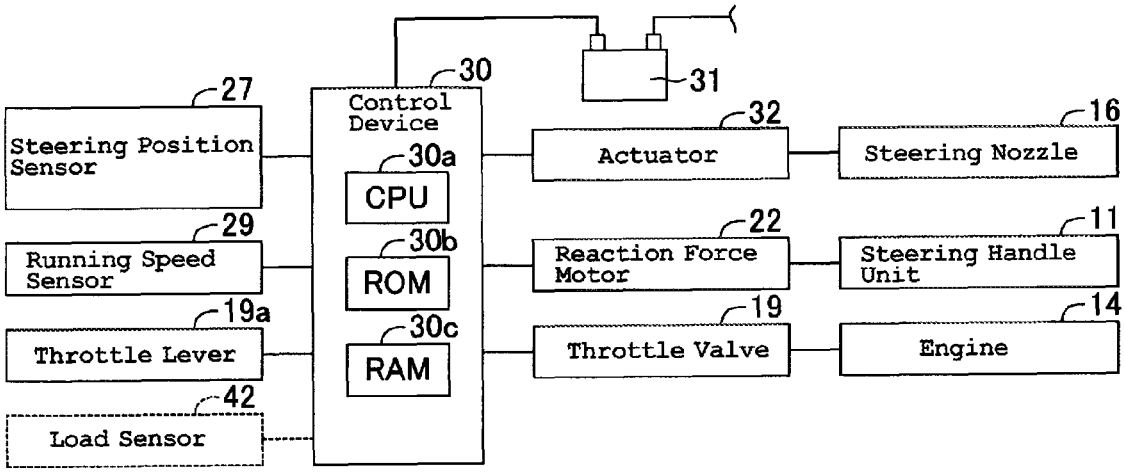
FIG. 6 is a block diagram of an embodiment of a control system that can be used with the personal watercraft.

The throttle body can have a throttle valve 19 (see FIG. 6). The intake device 17 introduces air from outside of the vehicle body to the engine 14. The amount of air flow can be adjusted or "metered" by the throttle valve 19 which can be moved between an opened and closed position.

The fuel supplied from the fuel tank 13 through a fuel supply device (not shown) can be mixed with the air supplied to the engine 14. A throttle lever 19*a* can be disposed adjacent to one of grips 11*a* of the steering handle unit 11. The throttle lever 19*a* can have a lever body pivotally supported by the steering handle unit 11. The lever body can be pulled toward or released away from the cylindrical surface of the grip 11*a*. The throttle valve 19 can thus move between the opened position and the closed position in accordance with the operation of the throttle lever 19*a*. The throttle lever 19*a* can be connected to the throttle valve 19 through a mechanical linkage or with an electronic control system.

Figure 3:
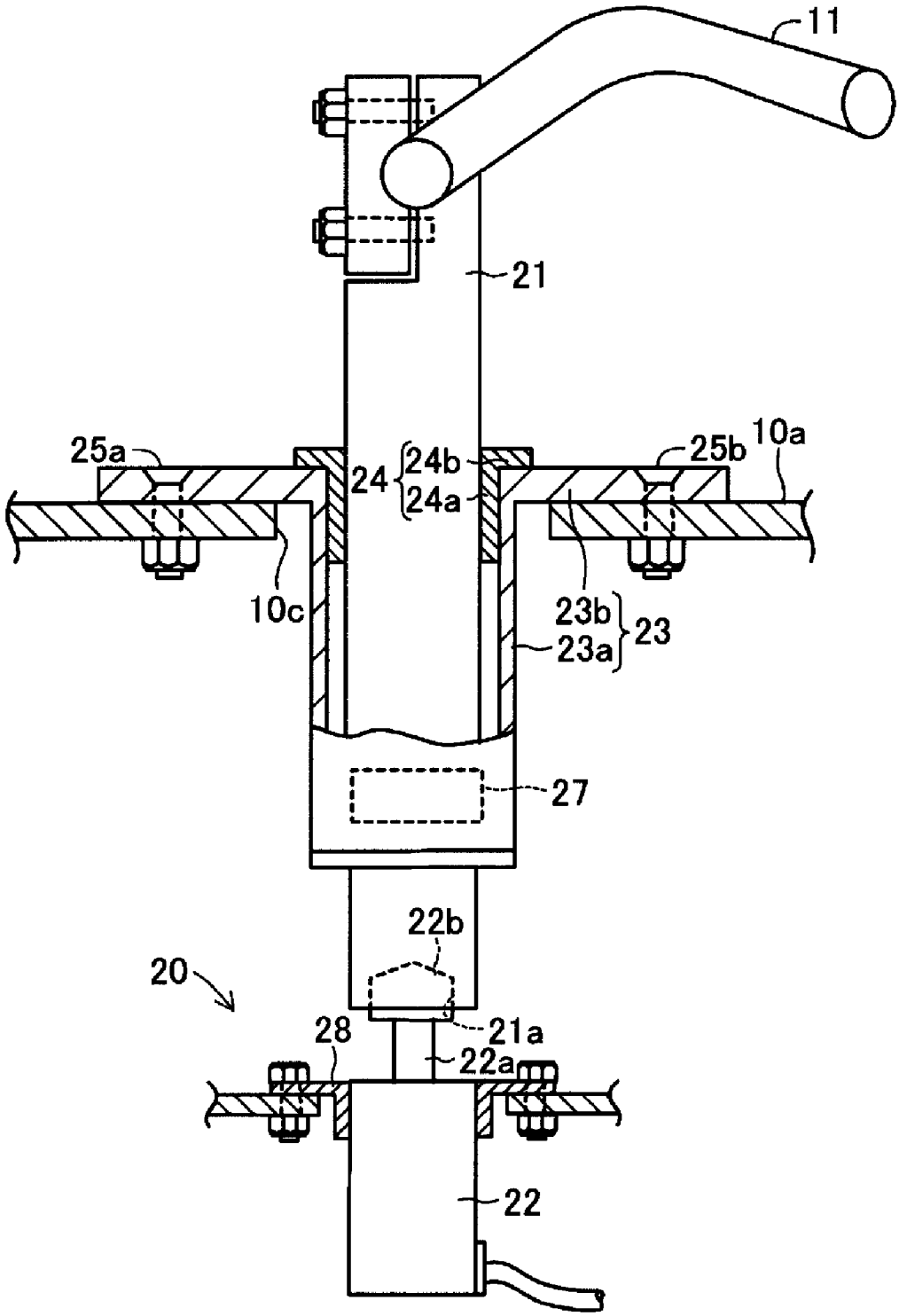
FIG. 3 is a sectional view of an embodiment of the steering shaft and adjacent components of the personal watercraft.

As shown in FIG. 3, a mechanism including a resistance generating device 20 can be disposed in a lower portion of the steering handle unit 11 inside of the personal watercraft body 10. The resistance generating device 20 can include a steering shaft 21 and a reaction force motor 22. The steering shaft 21 can be coupled with the steering handle unit 11 at the center of the steering handle unit 11. In this configuration, the steering shaft 21 can extend downward generally in the vertical direction. However, other configurations can also be used.

The steering shaft 21 can pivot in accordance with the operation of the steering handle unit 11. The reaction force motor 22 can be coupled with a bottom end of the steering shaft 21. The reaction force motor 22 can operate in accordance with a running speed of the vehicle body 10 to generate certain resistance (reaction force) against the rotational movement of the steering shaft 21.

Additionally, in some embodiments, a running speed sensor 29 can be disposed at a bottom end of the stern of the vehicle body 10 and can be configured to output a signal corresponding to a speed of the vehicle body 10. The reaction force motor 22 can be configured to operate in response to a detection amount of the running speed sensor 29. In some embodiments, the vehicle speed can be estimated based on other parameters, for example, the engine speed. However, other techniques can also be used to determine the vehicle speed.

A steering shaft bearing 23, which can be fixed to the deck 10*a*, and a slide support 24 together can support the steering shaft 21 for pivotal movement about an axis of the shaft 21. The steering shaft bearing 23 can have a cylindrical steering shaft insert section 23*a* through which the steering shaft 21 can extend and a flanged attaching section 23*b* formed at a top end of the insert section 23 to extend outward.

The steering shaft insert section 23*a* of the steering shaft bearing 23 can be inserted into an aperture 10*c* defined in the deck 10*a* so that the attaching section 23*b* can be positioned on the top surface of the deck 10*a*. The attaching section 23*b* can be fixed to the deck 10*a* by fastening members. For example, bolts 25*a* and nuts 25*b* can be used to attach the steering shaft bearing 23 to the deck 10*a*.

The slide support 24 can have a cylindrical steering shaft slide contact section 24*a* and a flanged limiter section 24*b*. The steering shaft 21 can slidably contact the inner surface of the slide contact section 24*a*. The limiter section 24*b* can be formed at the top end of the slide contact section 24*a* to restrain the slide support 24. The slide support 24 can be attached to the steering shaft bearing 23 by inserting the steering shaft slide contact section 24*a* into the steering shaft insert section 23*a* and positioning the limiter section 24*b* on the top surface of the attaching section 23*b*.

In some embodiments, the steering position sensor 27 can be positioned in the bottom end portion of the steering shaft insert section 23*a*. The steering position sensor 27 can be positioned relative to a particular location on the cylindrical surface of the steering shaft 21 can be configured to detect a steering angle (operation amount) of the steering shaft 21.

Figure 4:
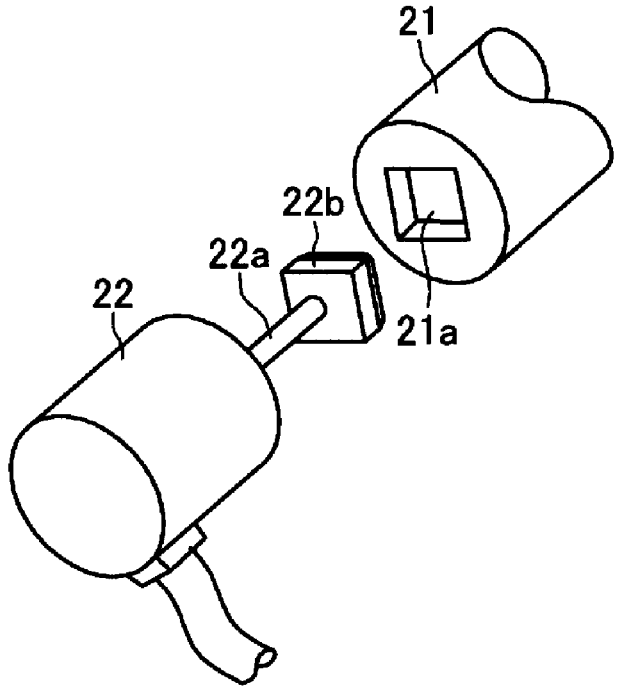
FIG. 4 is a schematic exploded perspective view of an embodiment of a resistance generating device that can be used with the personal watercraft.

As shown in FIG. 4, the bottom end portion of the steering shaft 21 can define an engaging recess 21*a* with an open end which can have a cubic or rectangular parallelepiped shape and a deep end which can have a pyramid shape. However, other configurations can also be used.

A top end of a rotary shaft 22*a* of the reaction motor 22 has an engaging projection 22*b* which can be engaged with the engaging recess 21*a*. When the engaging projection 22*b* engages with the engaging recess 21*a*, the reaction force motor 22 can be coupled with the steering shaft 21. The rotary shaft 22*a* and the engaging projection 22*b* synchronously pivot with the steering shaft 21 about an axis of the rotary shaft 22*a*. As shown in FIG. 3, a support member 28 can be used to the reaction motor 22 to the personal watercraft body 10.

Figure 5:
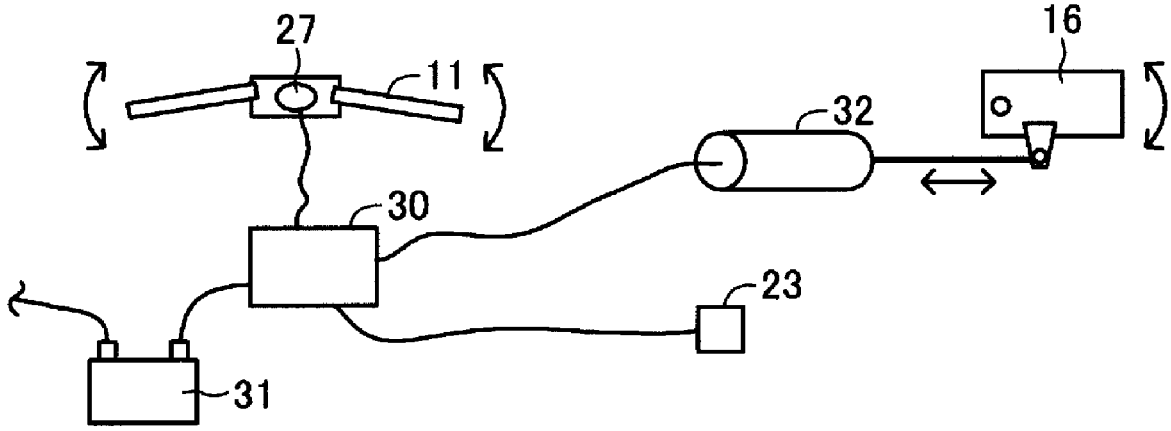
FIG. 5 is a block diagram of an embodiment of the steering handle unit and a steering nozzle of steering system that can be used with the personal watercraft.

As shown in FIGS. 5 and 6, the personal watercraft A can have a control device 30, a battery 31 and an actuator 32. The respective devices and components are connected to each other through wirings with any other communication technique, including wireless connectors. The control device 30 can be formed with a micro-computer including a CPU 30*a*, a ROM or ROMs 30*b*, a RAM or RAMs 30*c* and so forth. The control device 30 can be configured to control an operation of the actuator 32 in response to a detection amount given by the steering position sensor 27. In some embodiments such as those shown in FIGS. 5 and 6, the running speed of the personal watercraft A can be detected by the running speed sensor 29 and input into the control device 30.

Figure 7:
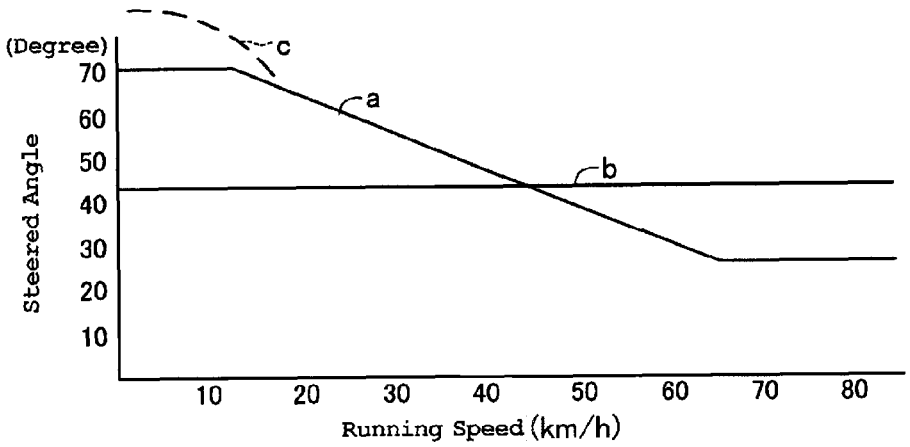
FIG. 7 is a graph showing exemplary maximum steered angles relative to running speeds that can be used with the personal watercraft.

Additionally, in some embodiments, the control device 30 can be configured to control the actuator 32 based upon a correlation between the detection amount of the steering position sensor 27 and a detection amount of the running speed sensor 29. For example, the graph of FIG. 7 represents an exemplary but non-limiting predetermined relationship between steering angles and running speeds that can be used by the control device 30. In such an exemplary configuration, the RAM 30*c* can store the graph of FIG. 7 as map data. The CPU 30*a* can execute a preset program or control routine stored in the ROM 30*b* while reading the map data to operate the actuator 32. The steering nozzle 16 thus pivots rightward or leftward in accordance with the operation of the actuator 32 and the personal watercraft body 10 thereby turns in the corresponding direction.

However, other configurations can also be used. The actuator 32 can be positioned adjacent to the steering nozzle in the rear portion of the vehicle body 10.

The horizontal axis of the graph of FIG. 7 represents a range of running speeds of the vehicle body 10, while the vertical axis thereof represents the maximum allowable angles of rotation of the steering nozzle 16. The curve "a" represents the maximum allowable steered angle of the steering nozzle 16 over the range of running speeds listed on the horizontal axis. In other words, the curve "a" represents the steered angle of the steering nozzle 16 over the range of running speeds listed on the horizontal axis when the steering handle unit 11 is turned by the operator to the maximum left or right angle permitted by the steering handle unit 11.

In some embodiments, with reference to FIG. 7 (in comparison with a straight line which is described later), the steering angle of the steering handle unit 11 and the steered angle of the steering nozzle 16 can be equal to each other when the running speed of the watercraft A is generally 45 km/hour. The maximum steered angle of the steering nozzle 16 becomes larger relative to the steering angle of the steering handle unit 11 (i.e., the steering ratio becomes larger) when the running speed is generally less than 45 km/hour. On the other hand, the steered angle of the steering nozzle 16 becomes smaller relative to the steering angle of the steering handle unit 11 (i.e., the steering ratio becomes smaller) when the running speed is generally 45 km/hour or greater.

As illustrated in FIG. 7, the steering ratio can also be set such that the steered angle of the steering nozzle 16 remains constant in a low range of the running speed such as, for example, 0 km/hour to 13 km/hour, and also in a high speed range thereof such as, for example, 65 km/hour or higher. In the relationships between the steering angles of the steering handle unit 11 and the steered angles of the steering nozzle 16, when the steering angle is "0," i.e., when the personal watercraft A moves in a straight line, the steered angle is also "0" regardless of the running speed. The larger the steering angle, the larger the difference between the steering angle and the steered angle. The maximum difference between the steering angle and the steered angle is illustrated by the horizontal portion of curve "a" corresponding with speeds in excess of 65 km/h. In one configuration, the steered angle cannot be greater than about 30 degrees for running speeds greater than 65 km/h.

Figure 8:
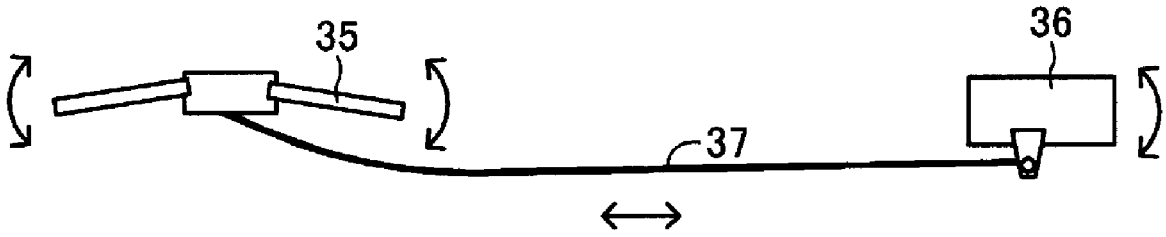
FIG. 8 is a schematic diagram of a push-pull cable type steering system.

If the steering handle unit 35 and the steering nozzle 36 were connected to each other through a push-pull cable 37 as shown in FIG. 8, the steering ratio would have a relation like the straight line [b] of FIG. 7 even though the steering handle unit 35 can be operated to the maximum in the right or left direction. That is, the steering angles and the steered angles are consistent with each other all the time regardless of the steering angle or the running speed. In the embodiments referred to in FIGS. 5-7, however, the steering ratio can be changed in accordance with the steering angles and the running speeds. The personal watercraft thus can be steered to an extent that is suitable for the respective running speeds.

As noted above, in some embodiments, the control device 30 can be also connected to the reaction force motor 22 to control the operation of the reaction force motor 22 based upon the detection amount of the running speed sensor 29. Through the reaction force motor 22, resistance can be generated whenever the steering handle unit 11 is operated and the operability of the steering handle unit 11 can be improved by the reaction force motor 22.

In some embodiments the control device 70 can be configured such that the resistance generated by the reaction force motor 22 becomes larger as the running speed of the vehicle body 10 becomes higher. Therefore, the operation of the steering handle unit 11 in a high speed range can be stabilized by the reaction force motor 22. However, other configurations can also be used.

In the above configuration, the steering handle unit 11 requires less force to pivot the steering handle unit 11 than is required for operating a conventional steering handle unit 35 attached to a steering handle nozzle 36 by the push-pull cable 37 (FIG. 8). This is because the actuator 32 and the steering nozzle 16 positioned adjacent to the actuator 32 are the only components that are mechanically connected to each other between the steering handle unit 11 and the steering nozzle 16. In other words, the reason that the steering handle unit 11 requires less force to pivot the steering handle unit 11 than in cable configurations is that certain components of the steering handle unit 11 (for example, the steering position sensor 27) are electrically connected to the actuator 32 through the control device 30. There is typically less resistance in these electrical connections than in the conventional mechanical connections. The handling load (resistance) of the steering handle unit 11 can be increased or decreased in accordance with the running speed of the personal watercraft body 10 and/or other factors.

To control the engine 14, the control device 30 moves the throttle valve 19 between the opened position and the closed position by controlling the rotational position of the throttle lever 19*a*. That is, an operation amount detecting sensor (not shown) can be disposed adjacent to the throttle lever 19*a* to detect the operation amount of the throttle lever 19*a*. The control device 30 can be configured to move the throttle valve 19 between the opened position and the closed position in accordance with a detection amount of the operation amount detecting sensor. The control device 30 can also be configured to move the throttle valve 19 to the opened position to make the output of the engine 14 larger when the steering angle of the steering handle unit 11 detected by the steering position sensor 27 becomes larger than a preset amount even though the throttle lever 19*a* is not operated.

When the throttle lever 19*a* is not operated, the engine 14 is under an idling condition and the personal watercraft A moves slowly. In this state, the rider can operate the steering handle unit 11 to make the steering angle larger than the preset amount so as to provide the personal watercraft A with additional thrust without operating the throttle lever 19*a*. This is useful when the personal watercraft leaves from or approaches the shore. That is, an operator of the personal watercraft can leave from or approach the shore more easily by operating the steering handle unit 11 to adjust thrust. However, other configurations can also be used.

The actuator 32 of the personal watercraft A can be positioned adjacent to the steering nozzle 16. The steering position sensor 27 and the actuator 32 can be connected to each other through the control device 30 and wirings. Because the constraints regarding the routing of electrical wirings are less onerous than with push-pull cables or other connectors, it is not necessary to dedicate any particular spaces in the interior of the engine compartment to accommodate the wires, as is required for the push-pull cables. This is partly because electrical wirings can be bent to a greater extent than the push-pull cables without affecting their operability. Thereby, the engine 14, the intake device 17, the exhaust device 18, and other components can be arranged in the engine room without this restriction.

In the structures described above, when the rider runs the personal watercraft A, first, the rider needs to turn on a switch (not shown) disposed adjacent to the steering handle unit 11 to bring the personal watercraft A to a starting state for running. Then, the rider grasps the grips 11*a* and operates the throttle lever 19*a* with his or her fingers to pull the throttle lever 19*a* toward the grip 11*a*. Thereby, the throttle valve 10 is moved toward the opened position in accordance with the operational amount of the throttle lever 19*a*.

In this configuration, as the throttle lever 19*a* is pulled closer to the grip 11*a*, the opening of the throttle valve becomes larger and the personal watercraft A runs at a higher speed. Conversely, as the throttle lever 19*a* is released and moves away from the grip 11*a*, the opening of the throttle valve becomes smaller and the personal watercraft A runs at a lower speed. Also, when the rider turns the steering handle unit 11 while pulling the throttle lever 19*a* toward the grip 11*a*, the personal watercraft A advances in the direction in accordance with a response to the operation of the steering handle unit 11. In this manner, the actuator 32 operates in accordance with the steering angle of the steering handle unit 11 to move the steering nozzle 16 rightward or leftward. The running direction of the personal watercraft thus can be changed.

When the rider of the personal watercraft A starts to move near the shore, the rider can release the throttle lever 19*a* to allow the throttle lever 19*a* to be placed at the farthest position from the grip 11*a* so as to bring the engine 14 to an idling state. The rider can also turn the steering handle unit 11 clockwise or counterclockwise until the steering angle becomes larger than the preset angle. Thereby, the engine 14 starts to increase in speed. Accordingly, the personal watercraft A can leave from the shore at a low speed only with the simple operation of the steering handle unit 11.

Because, in some embodiments, the steering ratio becomes larger in the low speed running range, the steered angle of the steering nozzle can be large relative to the operation amount of the steering handle unit 11. The personal watercraft thus can be precisely steered under such a low speed running condition. The operability of the steering handle unit 11 is improved, accordingly.

When the personal watercraft A runs in a normal range of running speeds, as in those represented by the line segment of curve "a" of FIG. 7 located toward the center of the graph, but generally less than 45 km/hour, the control device controls the steering nozzle 16 in such a manner that the steered angle of the steering nozzle 16 becomes large relative to the steering angle of the steering handle 11. However, when the personal watercraft A runs at a speed generally greater than 45 km/hour, the control device controls the steered angle of the steering nozzle 16 such that becomes small relative to the steering angle of the steering handle 11. Also, when the personal watercraft A runs at a high speed, the resistance generated by the reaction force motor 22 can become larger.

As described above, the actuator 32 can be electrically connected to the steering position sensor 27 (which detects the steering angle of the steering handle unit 11), and can pivot the steering nozzle 16. Therefore, because the actuator 32 is electrically connected as opposed to mechanically connected to the steering nozzle 16, the force of the water on the steering nozzle 16 is not transmitted to the steering handle unit 11. However, in some embodiments, a load of the steering handle unit 11 can be adjusted regardless of the running speed of the personal watercraft A. Also, because no space is necessary for laying the push-pull cable 37 in the engine room, any devices and components such as, for example, the engine 14 can be arranged in the engine room mostly without any restrictions. The engine room thus can be effectively used.

Because the steering ratio can be varied in accordance with the steering angle and the running speed, the operation of the steering handle unit 11 and the rotational movement of the steering nozzle 16 can be made in suitable fashions for the lower speed running conditions, for intermediate speed running conditions and for higher speed running conditions. In addition, because of the operation of the reaction force motor 22, the resistance can be added to the steering handle unit 11 in accordance with the running speed.

Figure 9:
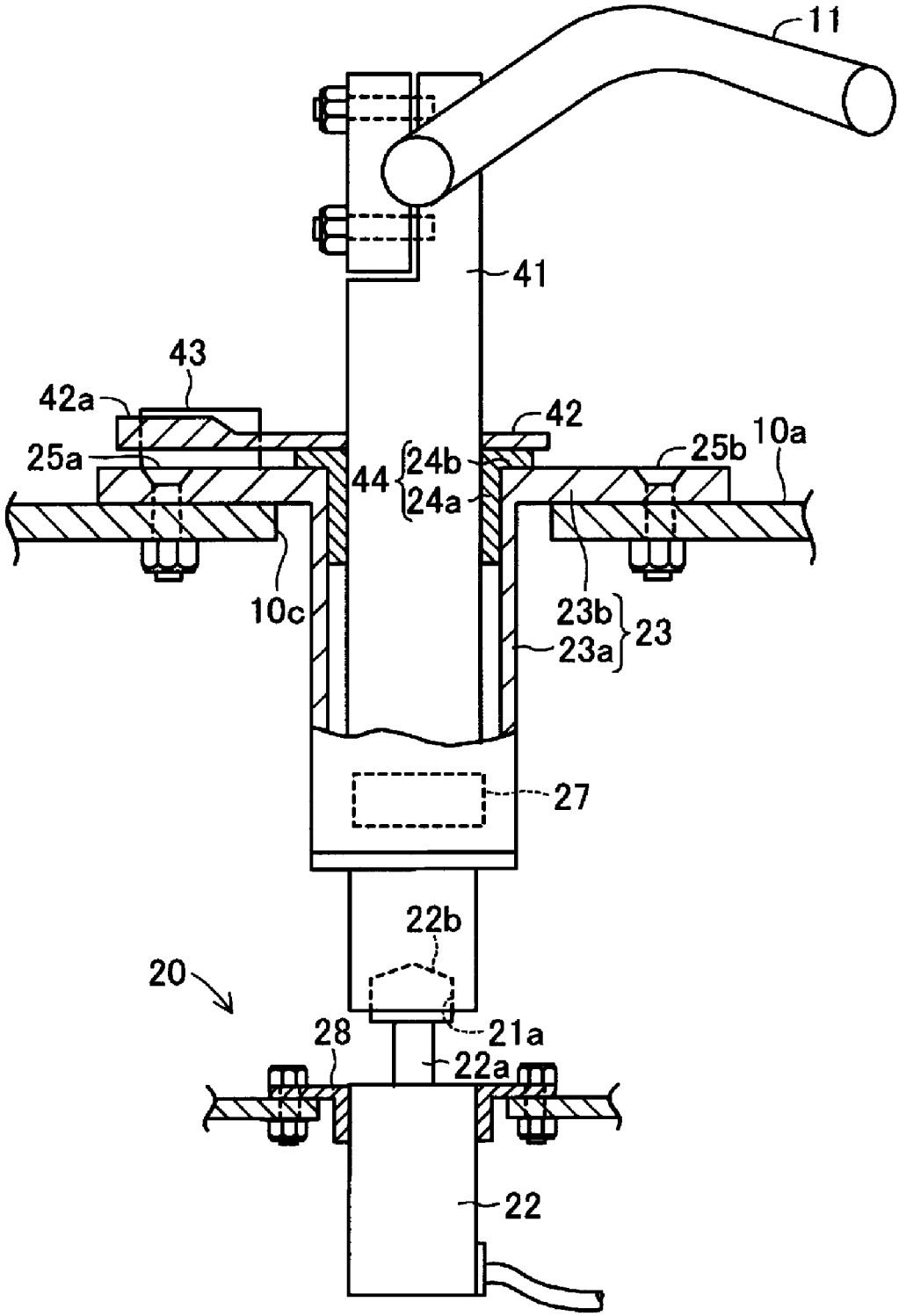
FIG. 9 is a sectional view of a modification of the steering shaft and adjacent components of FIG. 3.
Figure 10:
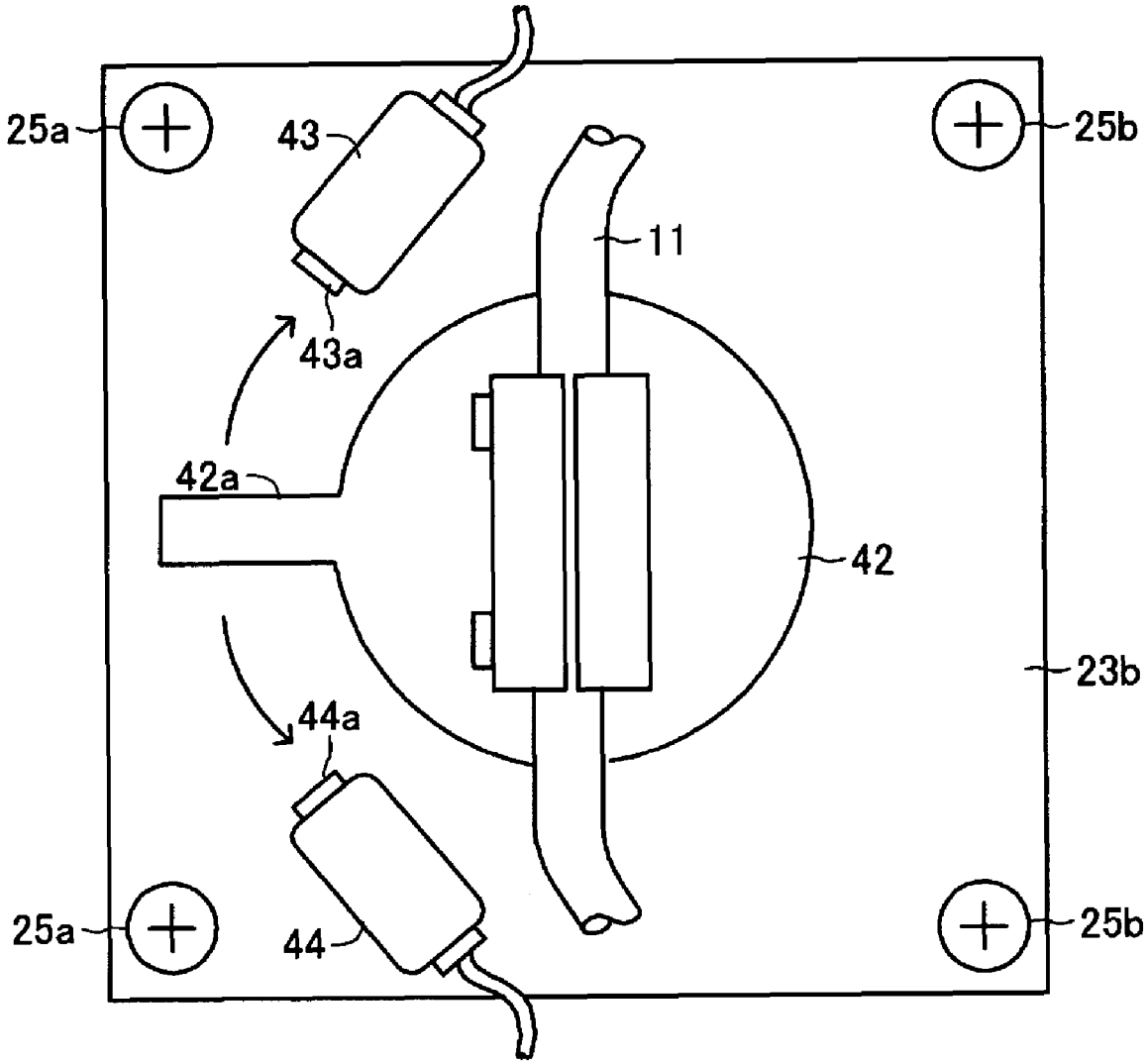
FIG. 10 is an aerial view of the embodiment of the steering shaft and adjacent components of the present inventions illustrated in FIG. 9.

FIGS. 9 and 10 show a steering shaft 41 and portions around the steering shaft 41 which belong to a personal watercraft modified in accordance with another embodiment. Note that the steering shaft 41 is not shown in FIG. 10. This personal watercraft has a disk-shaped support section 42 just above a slide support 44 of the steering shaft 41.

A press portion 42*a* projects from a peripheral end of the support section 42 to extend outwardly. The press portion 42*a* rotates in a range of rotation. Load sensors 43 and 44 are positioned at both ends of the rotational range. Each load sensor 43 or 44 has a contact piece 43*a* or 44*a* at an end thereof.

When the steering shaft 41 pivots about an axis thereof by an angle closer to the maximum angle in a right or left direction, the press portion 42*a* of the support section 42 and the contact piece 43*a* of the load sensor 43 or the contact piece 44*a* of the load sensor 44 come into contact with each other. The load sensors 43 and 44 can be connected to the control device 30.

The control device 30 receives a signal indicative of a load generated when the press portion 42*a* presses the contact piece 43*a* of the load sensor 43 or the contact piece 44*a* of the load sensor 44 and controls the operation of the engine 14 based upon the load. However, other configurations can also be used. Depending on the type of engine used, the control device 30 can alter the operation of the engine by any suitable technique for adjusting the power output of the engine such as by adjusting the ignition timing, adjusting an intake air amount by adjusting the throttle valve position, for example or, for a diesel engine, adjusting the fuel intake amount.

The map data stored in the RAM 30*c* of the personal watercraft can further include a mode for controlling the condition of leaving from and approaching the shore (leaving and approaching mode) which is indicated by the dashed line "c" of FIG. 7 to improve the precision of the steering operation in the curve "a" of FIG. 7 in a low speed range in which the running speed is lower than 15 km/hour. The leaving and approaching mode indicated by the dashed line "c" is the mode used when the vehicle body 10 leaves from or approaches the shore with a running speed lower than 15 km/hour. A steering ratio and a change rate in this mode are larger than those of the mode indicated by the curve "a" so that the maximum steered angle of the steering nozzle 16 can be approximately 80-85 degrees in comparison with the maximum steered angle of about 70 degrees in the curve "a".

When leaving and approaching the shore, the steering nozzle can pivot by the angle which can be large enough to compensate for a lack of a thrust at the low speed. Other features of the structure of this personal watercraft of this embodiment are the same as those of the personal watercraft A in the embodiment described above. Accordingly, the same features are assigned with the same numbers and symbols and will not be described repeatedly.

In this embodiment, when the personal watercraft starts to move near the shore, the rider releases the throttle lever 19*a* to bring the engine 14 to an idling state. Then, the rider turns the steering handle unit 11 clockwise or counterclockwise so that the press portion 42*a* of the support section 42 contacts with the contact piece 43*a* of the load sensor 43 or the contact piece 44*a* of the load sensor 44. Thereby, because the output of the engine 14 increases, the personal watercraft can leave from the shore only with the simple operation of the steering handle unit.

In this configuration, because the steering ratio is set to be larger than that indicated by the curve "a" of FIG. 7 and the change rate is also set to be larger, the steered angle of the steering nozzle 16 can be even larger than the steered angle based on curve "a" and the precision of the steering operation can be improved. Also, when the personal watercraft approaches the shore, the personal watercraft can approach the shore with the simple operation of the steering handle unit 11.

The personal watercraft is not limited to the embodiments discussed above and can include other embodiments, modifications and alternatives. For example, the data for setting the steering ratio used in the present inventions is not limited to the map data of FIG. 7 and can be modified properly. The first embodiment described above has the function such that the output of the engine 14 increases when the steering angle of the steering handle unit 11 becomes larger than the preset angle, while the second embodiment has the further function, in addition to the function noted above, that uses the press portion 42*a* of the support section 42 and the load sensors 43, 44. However, either one of the functions can be employed. Further, the other structures of the personal watercraft A and the personal watercraft in the embodiments described above can be modified properly in the technical scope of the present inventions.

Although these inventions have been disclosed in the context of certain preferred embodiments and examples, it will be understood by those skilled in the art that the present inventions extend beyond the disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A personal watercraft comprising:

a steering unit;

a steering nozzle arranged to pivot in accordance with an operation of the steering unit to change a traveling direction of a body of the personal watercraft;

a steering position sensor configured to detect a steering angle of the steering unit;

an actuator arranged to pivot the steering nozzle to change a steered angle thereof;

a running speed sensor configured to detect a running speed of the body of the personal watercraft; and a control device programmed to determine an operational amount of the actuator based upon a detection amount of the steering position sensor, a detection amount of the running speed sensor, and a steering ratio preset relative to the steering angle of the steering unit and the running speed of the body, and to control an operation of the actuator in response to the operational amount so as to pivot the steering nozzle; wherein the control device is programmed to control an engine mounted to the body to increase an output of the engine when the steering angle of the steering unit detected by the steering position sensor becomes larger than a predetermined steering angle amount.

2. A personal watercraft comprising:

a steering unit;

a steering nozzle arranged to pivot in accordance with an operation of the steering unit to change a traveling direction of a body of the personal watercraft;

a steering position sensor configured to detect a steering angle of the steering unit;

an actuator arranged to pivot the steering nozzle to change a steered angle thereof;

a running speed sensor configured to detect a running speed of the body of the personal watercraft;

a control device programmed to determine an operational amount of the actuator based upon a detection amount of the steering position sensor, a detection amount of the running speed sensor, and a steering ratio preset relative to the steering angle of the steering unit and the running speed of the body, and to control an operation of the actuator in response to the operational amount so as to pivot the steering nozzle; and a resistance generating device configured to generate resistance against the operation of the steering unit in accordance with the running speed.

3. A personal watercraft comprising:

a steering unit;

a steering nozzle arranged to pivot in accordance with an operation of the steering unit to change a traveling direction of a body of the personal watercraft;

a steering position sensor configured to detect a steering angle of the steering unit;

an actuator arranged to pivot the steering nozzle to change a steered angle thereof;

a running speed sensor configured to detect a running speed of the body of the personal watercraft;

a control device programmed to determine an operational amount of the actuator based upon a detection amount of the steering position sensor, a detection amount of the running speed sensor, and a steering ratio preset relative to the steering angle of the steering unit and the running speed of the body, and to control an operation of the actuator in response to the operational amount so as to pivot the steering nozzle; and a load sensor configured to detect a load added to the steering unit when the steering angle of the steering unit is at a maximum turned position; wherein the control device is programmed to control an engine mounted to the body to increase an output of the engine based upon a detection amount of the load sensor.

4. A personal watercraft comprising:

a steering unit;

a steering nozzle arranged to pivot in accordance with an operation of the steering unit to change a traveling direction of a body of the personal watercraft;

a steering position sensor configured to detect a steering angle of the steering unit;

an actuator arranged to pivot the steering nozzle to change a steered angle thereof;

a running speed sensor configured to detect a running speed of the body of the personal watercraft; and a control device programmed to control the actuator based upon a detection amount of the steering position sensor and a detection amount of the running speed sensor so as to pivot the steering nozzle to a steered angle, the control device being programmed to control the actuator so as to limit the steered angle of the steering nozzle to a maximum amount that changes based on the running speed of the body when the steering unit is turned all the way to the left or all the way to the right; wherein the control device is programmed to control an engine mounted to the body to increase an output of the engine when the output of the engine detected by an engine output detector is less than a predetermined engine output amount and the steering angle of the steering unit detected by the steering position sensor becomes larger than a predetermined steering angle amount.

5. A personal watercraft comprising:

a steering unit;

a steering nozzle arranged to pivot in accordance with an operation of the steering unit to change a traveling direction of a body of the personal watercraft;

a steering position sensor configured to detect a steering angle of the steering unit;

an actuator arranged to pivot the steering nozzle to change a steered angle thereof;

a running speed sensor configured to detect a running speed of the body of the personal watercraft;

a control device programmed to control the actuator based upon a detection amount of the steering position sensor and a detection amount of the running speed sensor so as to pivot the steering nozzle to a steered angle, the control device being programmed to control the actuator so as to limit the steered angle of the steering nozzle to a maximum amount that changes based on the running speed of the body when the steering unit is turned all the way to the left or all the way to the right; and a resistance generating device configured to generate resistance against the operation of the steering unit in accordance with the running speed.

6. A personal watercraft comprising:

a steering unit;

a steering nozzle arranged to pivot in accordance with an operation of the steering unit to change a traveling direction of a body of the personal watercraft;

a steering position sensor configured to detect a steering angle of the steering unit;

an actuator arranged to pivot the steering nozzle to change a steered angle thereof;

a running speed sensor configured to detect a running speed of the body of the personal watercraft;

a control device programmed to control the actuator based upon a detection amount of the steering position sensor and a detection amount of the running speed sensor so as to pivot the steering nozzle to a steered angle, the control device being programmed to control the actuator so as to limit the steered angle of the steering nozzle to a maximum amount that changes based on the running speed of the body when the steering unit is turned all the way to the left or all the way to the right; and a load sensor configured to detect a load added to the steering unit when the steering angle of the steering unit is a maximum turning position; wherein the control device is programmed to control an engine mounted to the body to increase an output of the engine based upon a detection amount of the load sensor.

7. A method of controlling a traveling direction of a body of a personal watercraft relative to a running speed of the body of the personal watercraft, the method comprising the steps of:

detecting a steering angle of a steering unit of the personal watercraft with a steering position sensor;

detecting a running speed of the body of the personal watercraft with a running speed sensor;

pivoting a steering nozzle with an actuator that is controlled by a control device configured to determine an operational amount of the actuator based upon a detection amount of the steering position sensor, a detection amount of the running speed sensor, and a steering ratio preset with reference to the steering angle of the steering unit and the running speed of the body, and to control an operation of the actuator based on the operational amount so as to pivot the steering nozzle; and increasing an output of an engine mounted to the body when the steering angle of the steering unit detected by the steering position sensor becomes larger than a predetermined steering angle amount and the running speed is less than or equal to a predetermined running speed amount.

8. A method of controlling a traveling direction of a body of a personal watercraft relative to a running speed of the body of the personal watercraft, the method comprising the steps of:

detecting a steering angle of a steering unit of the personal watercraft with a steering position sensor;

detecting a running speed of the body of the personal watercraft with a running speed sensor;

pivoting a steering nozzle with an actuator that is controlled by a control device configured to determine an operational amount of the actuator based upon a detection amount of the steering position sensor, a detection amount of the running speed sensor, and a steering ratio preset with reference to the steering angle of the steering unit and the running speed of the body, and to control an operation of the actuator based on the operational amount so as to pivot the steering nozzle;

increasing an output of an engine mounted to the body when the steering angle of the steering unit detected by the steering position sensor becomes larger than a predetermined steering angle amount and the running speed is less than or equal to a predetermined running speed amount;

detecting a load added to a steering unit with a load sensor when a steering angle of the steering unit is a maximum steering angle of the steering unit of the personal watercraft; and increasing an output of an engine mounted to the body when a detection amount of the load sensor is equal to or greater than a predetermined value.

* * * * *